United States Patent [19]

Selines et al.

[11] Patent Number: 4,465,513

[45] Date of Patent: Aug. 14, 1984

[54] PROCESS TO CONTROL THE SHAPE OF INCLUSIONS IN STEELS

[75] Inventors: Ronald J. Selines, North Salem; Lawrence J. Hagerty, Ossining; Donald C. Hilty, Sanborn, all of N.Y.

[73] Assignee: Union Carbide Corporation, Danbury, Conn.

[21] Appl. No.: 538,474

[22] Filed: Oct. 3, 1983

[51] Int. Cl.[3] ..... C21C 7/02

[52] U.S. Cl. ..... 75/53; 75/58

[58] Field of Search ..... 75/53, 58

[56] References Cited

U.S. PATENT DOCUMENTS 1,848,323 3/1932 Davies ..... 75/93 G
4,286,984 9/1981 Luyckx ..... 75/58
4,294,611 10/1981 Tamás ..... 75/58
4,317,678 3/1982 Faulring ..... 75/58

OTHER PUBLICATIONS

Hilty, et al. Modification of Inclusions of Calcium, AIME, Feb. 1975.

Sanbongi, Controlling Sulfide Shape With Rare Earths Or Calcium During The Processing of Molten Steels, ISIG, vol. 19, 1979.

Grip, Ladle Metallurgy in SSAB, Scandinavian Journal of Metallurgy, vol. 9, 1980, pp. 121–127.

*Primary Examiner*—Peter D. Rosenberg
*Attorney, Agent, or Firm*—Stanley Ktorides

[57] ABSTRACT

A process which enables one to employ calcium as an inclusion shape control additive without need for complicated addition procedures.

8 Claims, No Drawings

PROCESS TO CONTROL THE SHAPE OF INCLUSIONS IN STEELS

TECHNICAL FIELD

This invention relates generally to the production of steel and more particularly to the alteration of the shape of inclusions in steel to produce steel having superior mechanical properties.

BACKGROUND ART

Inclusions are oxides or sulfides in steel which have a detrimental effect on mechanical properties of the steel such as ductility, fracture toughness, fatigue strength, and stress corrosion resistance. It is known that the detrimental effect of inclusions can be significantly reduced if the shape of the inclusions can be controlled such that the inclusions are of generally spherical shape rather than of long and thin shape. Such shape control is achieved by adding substances to the steel which combine with the normal oxide and/or sulfide forming elements to form complex inclusions which are essentially spherical in shape and which maintain their shape during hot working operations.

One additive which may be added for inclusion shape control is calcium. However, calcium has disadvantages which have heretofore detracted from its utility as an inclusion shape control additive.

Calcium has a relatively high vapor pressure at steelmaking temperatures and a relatively low density compared to molten steel. Furthermore it has relatively limited solubility in steel. Therefore it is very difficult to effectively provide the requisite amount of calcium to the steel to successfully modify oxide and sulfide inclusions to control their shape. Calcium tends to volatize rather than be dissolved in a steel bath because of its high vapor pressure. Calcium also tends to float out of the steel melt and into the slag before it can dissolve due to its limited solubility and low density. Consequently, specialized and expensive techniques are employed in order to successfully employ calcium as an inclusion shape control additive. One technique is the injection of powdered calcium containing compounds deep below the surface of the melt in the ladle. This technique has disadvantages because the required injection equipment is expensive and costly to maintain, the injection process results in a temperature loss to the melt and the injection process inevitably introduces unwanted nitrogen, oxygen and hydrogen to the steel from the air over the splashing melt. Another technique involves the introduction of calcium to the melt as cored wire, i.e., calcium metal encased in a steel sheath. The disadvantages of this technique are the high cost of cored wire and difficulty in effectively treating large batches of steel due to problems in penetrating the slag layer which is usually present as well as limitations on the rate at which wire can be added.

Calcium, despite these disadvantages, is generally the preferred additive for inclusion shape control. This is because calcium modifies oxide and sulfide inclusions to give excellently shaped inclusions which are very uniformly distributed throughout the steel. Moreover, the use of calcium does not adversely affect total inclusion content and reduces the tendency of some steels to clog nozzles during casting operations. Thus one can achieve a steel having good mechanical properties and superior castability because the inclusions have been modified by calcium addition, albeit at a high cost.

It is therefore desirable to provide a method which will allow calcium to be used as an inclusion shape control additive without need to resort to expensive and complicated methods to successfully add sufficient calcium to the melt.

It is an object of this invention to provide an improved method to control the shape of inclusions in steel.

It is another object of this invention to provide an improved process for the production of steel wherein calcium can be employed to control the shape of inclusions.

It is a further object of this invention to provide a process for the production of steel wherein calcium can be employed to control the shape of inclusions and can be successfully added to the steel melt without need for complicated or expensive addition techniques.

SUMMARY OF THE INVENTION

The above and other objects which will become apparent to one skilled in the art upon a reading of this disclosure are attained by:

A process for the production of steel wherein inclusions are generally spherical in shape comprising:

(A) producing a highly refined steel melt having a sulfur content of not more than 0.005 weight percent, a dissolved oxygen content of not more than 0.005 weight percent and a temperature not exceeding 3000° F.; and (B) adding to said highly refined steel calcium in an amount of from 3 to 25 times the amount of sulfur present.

The term "inclusions" is used herein to mean oxygen and/or sulfur containing phases present in all steels.

The term "ladle" is used herein to mean a refractory lined vessel used to transfer molten steel from the steel refining vessel to another vessel such as a tundish or mold.

The term "tundish" is used herein to mean a refractory lined vessel used in the continuous casting process to transfer molten steel from a ladle to a mold.

DETAILED DESCRIPTION

In the process of this invention a steel melt is refined to a very low level of sulfur and oxygen. Such highly refined steel has a sulfur content not exceeding 0.005 weight percent of the melt and a dissolved oxygen content not exceeding 0.005 weight percent of the melt.

Any steel refining process which can achieve such low levels of sulfur and oxygen is useful in the practice of the process of this invention. Among such refining processes one can name the AOD, VAD, and other ladle furnace processes as well as the Perrin and other ladle processes using basic desulfurizing slags. Those skilled in the art are familiar with these steelmaking terms and with their meanings.

A particularly preferred steel refining process for use in conjunction with the process of this invention is the argon oxygen decarburization process or AOD process which is a process for refining molten metals and alloys contained in a refining vessel provided with at least one submerged tuyere comprising:

(a) injecting into the melt through said tuyere(s) an oxygen-containing gas containing up to 90 percent of a dilution gas, wherein said dilution gas may function to reduce the partial pressure of the carbon monoxide in the gas bubbles formed during decarburization of the melt, alter the feed rate of oxygen to the melt without substantially altering the total injection gas flow rate, and/or serve as a protective fluid, and thereafter, (b) injecting a sparging gas into the melt through said tuyere(s) said sparging gas functioning to remove impurities from the melt by degassing, deoxidation, volatilization or by flotation of said impurities with subsequent entrapment or reaction with the slag. Useful dilution gases include argon, helium, hydrogen, nitrogen, steam or a hydrocarbon, and carbon dioxide. Useful sparging gases include argon, helium, nitrogen, carbon monoxide, carbon dioxide. Argon and nitrogen are the preferred dilution and sparging gas. Argon, nitrogen and carbon dioxide are the preferred protective fluids.

The AOD process is particularly preferred for use in conjunction with this invention because it can rapidly desulfurize to very low levels using inexpensive lime based slags as the desulfurization agent. In addition, this desulfurization method results in the presence of calcium in the oxide inclusions formed during the deoxidation/desulfurization step. This helps to ensure complete inclusion shape control and further reduces the amount of shape control addition required.

The temperature of the highly refined steel should not exceed 3000° F. at the time the calcium is added. This is important because temperatures above 3000° F. will have a detrimental effect on the ability of the calcium to successfully control the shape of inclusions. In particular, at temperatures exceeding 3000° F. the calcium will volatize to a great extent. As has been discussed, one of the most important advantages of the process of this invention is the ability to make the calcium addition simply without need for complicated and expensive procedures.

Although the calcium may be added at any time to the highly refined steel melt, it is preferred, if there is an opportunity, to add the calcium to the steel melt as the melt is being transferred from one vessel to another. It is most preferred that such addition be made to the transfer stream. This is because the action of the transfer or pouring stream acts to disperse and mix the calcium throughout the melt more rapidly than would be the case if calcium were merely added to the melt in a vessel. Examples of opportune times to add calcium to the highly refined steel include when the melt is being transferred from a refining vessel or a refining ladle to a transfer ladle, tundish or mold, or when the melt is being transferred from a transfer vessel into a mold. This method results in a short addition time which results in reduced temperature loss and less gas pickup.

It is important that the calcium be added to the melt in a manner which avoids substantial contact with the slag. This is because contact with the slag will result in calcium being dissolved into the slag rather than into the melt where it can act to produce the desired inclusion shape control. This desire to avoid substantial contact with the slag is another reason why it is preferable to add the calcium to the highly refined steel as it is being poured from one vessel to another. In this regard it is also preferred that some of the slag be removed from the bath prior to the calcium addition while leaving sufficient slag to provide an adequate cover.

The calcium shape control additive may be added in any convenient form, i.e., powder, chunks, briquettes, etc. The ease and flexibility of the addition of the shape control additive to the steel is a major aspect of the utility of the process of this invention. It is preferred that the calcium be added in the form of a calcium compound such as Calsibar™, calcium-silicon, Hypercal™ and Inco-cal™ as this will facilitate the retention of calcium in the melt rather than its volatilization.

The amount of calcium to be added will vary and will depend on the type of steel to be made, the condition and chemistry of the melt and slag, i.e., bath, and other factors. Generally calcium is added in an amount by weight of from 3 to 25 times the amount of sulfur present in the melt preferably from 10 to 20 times the amount of sulfur in the melt.

After the shape control additive is added to the melt, the melt is transferred to a mold or continuous casting machine where it is made into product.

A particularly preferred way to carry out the process of this invention is to add aluminum to the melt after the melt has been refined in, for example, the AOD vessel. Aluminum functions as a deoxidizer and thus improves the results obtained by addition of the shape control additive. The final aluminum content should be at least 0.005 weight percent to assure a low dissolved oxygen content but should not exceed 0.05 weight percent since high aluminum contents can lead to an undesirable increase in final inclusion content and can increase the amount of calcium required for inclusion shape control.

The inclusions in the steel produced by the process of this invention are generally spherical in shape and substantially maintain their shape during hot working and thus the steel does not suffer from reduced mechanical properties caused by elongated inclusions. Calcium may be employed as the shape control additive by a simple ladle addition and there is not need to resort to complicated addition techniques.

Applicants are not certain why the process of this invention produces such advantageous results. While not wishing to be held to any theory, applicants offer the following explanation which may describe at least part of the reason for the advantages observed. Applicants believe that the key to the advantages is the highly refined state to which the steel is brought prior to the addition of the shape control additive. Because the melt has a very low amount of sulfur and oxygen present, a correspondingly smaller amount than heretofore necessary dissolved calcium is needed.

Furthermore, desulfurization to the requisite low level requires basic lime containing slag and results in some amount of calcium being present in the steel and further reduces the amount of additional calcium required. These effects combine to reduce the total amount of calcium required such that a simple and inexpensive ladle addition method becomes sufficient and pneumatic injection of fine powder, or addition of expensive calcium cored wire, is not necessary.

The following example serves to further illustrate the process of this invention. It is presented for illustrative purposes and is not intended to be limiting.

EXAMPLE 1

A 42 ton heat of grade 4150 low alloy steel was refined in an AOD converter and a portion of the slag was decanted from the converter leaving sufficient slag to provide an adequate cover. Trim additions to the AOD vessel prior to tap yielded the following chemical composition expressed in weight percent.

| Al | Ca | S | O | C | Si | Mn | Cr |
|---|---|---|---|---|---|---|---|
| 0.021 | 0.0005 | 0.002 | 0.0043 | 0.48 | 0.11 | 0.80 | 0.94 |

The oxygen term includes both dissolved and combined oxygen.

While tapping the heat from the AOD vessel into a high alumina ladle, an addition of 160 pounds of Calsibar TM, containing from 14 to 17 percent calcium, was made by throwing four 40 pound bags of Calsibar into the tap stream when the ladle was about one-third full. The tap temperature of the melt was 2970° F.

The heat was stirred gently in the ladle for one minute with argon through a porous plug. A bottom poured teeming operation followed 12 minutes after stirring was completed. The final product chemistry was taken at both outer diameter and mid-radius ingot locations and was as follows:

| Location | Al | Ca | S | O | C | Si | Mn | Cr |
|---|---|---|---|---|---|---|---|---|
| Mid-radius | 0.015 | 0.0019 | 0.002 | 0.0032 | 0.52 | 0.25 | 0.81 | 0.95 |
| Outer diameter | 0.014 | 0.0016 | 0.002 | 0.0040 | 0.52 | 0.24 | 0.81 | 0.94 |

Final product evaluation showed the non-metallic inclusions to be widely dispersed calcium modified oxides and oxysulfides. The sulfur was associated with calcium and no manganese sulfides were observed. The mechanical properties of the steel were nearly isotropic after a hot work reduction of about 4 to 1. The volume percent of inclusions was 0.028 percent.

We claim:

1. A process for the production of steels wherein oxide and sulfide containing inclusions are generally spherical in shape characterized by adding calcium directly to a steel melt without need for pneumatic injection of the calcium, cored wire or other means of shielding the calcium, comprising:

(A) producing by a refining process employing a basic desulfurizing slag a highly refined steel melt having a sulfur content of not more than 0.005 weight percent, a dissolved oxygen content of not more than 0.005 weight percent and a temperature not exceeding 3000° F.; and (B) adding calcium directly to said highly refined steel in an amount of from 3 to 25 times the amount of sulfur present, said calcium being introduced in bulk form such as powder, chunks and briquettes without the need for pneumatic injection of the calcium, cored wire or other means of shielding the calcium.

2. The process of claim 1 wherein calcium is added in an amount of from 10 to 20 times the amount of sulfur present.

3. The process of claim 1 wherein aluminum is added to the melt prior to step (B) in an amount such that the final aluminum content is between 0.05 and 0.005 weight percent.

4. The process of claim 1 wherein said highly refined steel melt of step (A) is produced by the AOD process.

5. The process of claim 1 wherein the calcium is in the form of Calsibar TM.

6. The process of claim 1 further comprising pouring a stream of said highly refined steel melt and adding the calcium to said stream.

7. The process of claim 1 wherein the highly refined steel melt is produced in part by desulfurization with a lime based slag.

8. The process of claim 1 wherein slag which is associated with the highly refined melt is partially removed prior to step (B).

* * * * *